US010252230B2

(12) United States Patent
Ord et al.

(10) Patent No.: US 10,252,230 B2
(45) Date of Patent: Apr. 9, 2019

(54) TINTING MACHINE AND METHOD FOR DISPENSING COLORANT INTO A PAINT CONTAINER WITH BASE PAINT

(71) Applicant: Akzo Nobel Coatings International B.V., Arnhem (NL)

(72) Inventors: Christopher John Ord, Royston (GB); Matthew Keith Fordham, Saffron Walden (GB); Michael Roger Cane, Bath (GB)

(73) Assignee: AKZO NOBEL COATINGS INTERNATIONAL B.V., Arnhem (NL)

( * ) Notice: Subject to any disclaimer, the term of this patent is extended or adjusted under 35 U.S.C. 154(b) by 0 days.

(21) Appl. No.: 15/773,749

(22) PCT Filed: Nov. 10, 2016

(86) PCT No.: PCT/EP2016/077202
§ 371 (c)(1),
(2) Date: May 4, 2018

(87) PCT Pub. No.: WO2017/081117
PCT Pub. Date: May 18, 2017

(65) Prior Publication Data

US 2018/0326379 A1 Nov. 15, 2018

(30) Foreign Application Priority Data

Nov. 12, 2015 (EP) ..... 15194230

(51) Int. Cl.
*B01F 13/10* (2006.01)
*B05B 15/55* (2018.01)

(52) U.S. Cl.
CPC ..... *B01F 13/1055* (2013.01); *B05B 15/55* (2018.02)

(58) Field of Classification Search
CPC ..... B01F 13/1055; B05B 15/55
See application file for complete search history.

(56) References Cited

U.S. PATENT DOCUMENTS 5,558,251 A 9/1996 Neri

FOREIGN PATENT DOCUMENTS

GB 1 451 850 A 10/1976
RU 144 325 U1 8/2014
(Continued)

*Primary Examiner* — Jason K Niesz
(74) *Attorney, Agent, or Firm* — McDonnell Boehnen Hulbert & Berghoff LLP

(57) ABSTRACT

A tinting machine (1) comprising one or more dispenser heads for dispensing colorant into a paint container (3), the one or more dispenser heads comprising a fluid outlet (16) for discharging the colorant into the paint container (3), an internal chamber (19) opening in the fluid outlet, and a piston (25) that is longitudinally and movably arranged inside the internal chamber. An outer side surface of the piston and the inner surface of the internal chamber define an annular space (29) and the piston comprises a circumventional protrusion (26) defining a constriction (28) in the annular space. By supplying cleaning fluid to the internal chamber and moving the piston between a first and a second position, the internal chamber can be cleaned from residual colorant with a small amount of cleaning fluid. The invention further relates to a method for dispensing one or more colorants into a paint container using such tinting machine.

13 Claims, 7 Drawing Sheets

(56) References Cited

FOREIGN PATENT DOCUMENTS

| | | | |
|---|---|---|---|
| SU | 579859 | A3 | 11/1977 |
| WO | 99/32205 | A1 | 7/1999 |
| WO | 99/34905 | A1 | 7/1999 |

TINTING MACHINE AND METHOD FOR DISPENSING COLORANT INTO A PAINT CONTAINER WITH BASE PAINT

This application is the U.S. national phase under 35 U.S.C. § 371 of international application PCT/EP2016/077202, filed Nov. 10, 2016, which claims priority to European application 15194230.7, filed Nov. 12, 2015.

FIELD OF THE INVENTION

The present invention relates to a tinting machine for dispensing colorant into a paint container and to a method for dispensing one or more colorants into a paint container with base paint using such tinting machine.

BACKGROUND OF THE INVENTION

Paint or similar coating compositions such as lacquers, varnishes or wood stains, is used by both the skilled professional decorator and the relatively unskilled do-it-yourself painter for a variety of reasons. Typically, these are to brighten up the surroundings and/or to match the color of a particular item of furniture, floor or wall covering, and other surfaces found in buildings. As consumers have become increasingly sophisticated and individual in their choice of colors, the demand for a wider range of colors has also increased.

This presents a problem to the paint manufacturer and the retailer or trade store keeper as the former has to produce many colors in small amounts, thus losing the economies of scale and, of course the retailer or store keeper has to provide additional space to store and display this plurality of colored paints. A typical paint would be architectural paint used on site at ambient temperatures.

Some paint manufacturers have addressed this problem by developing tinting machines. These operate on the basis that a variety of colors can be made by adding colorant to a factory produced base paint at the retailer's premises. Such machines are referred to as "in-store tinting machines". The term "in-store" is used herein to indicate a relation with small trade stores and retail outlets, in contrast to producing such coating compositions in a paint processing plant. A small number of different colored base paints, comprising three or four spanning the range of light to deep shades, is provided by the supplier to the retailer, in paint containers. Such a base paint is unfinished from the point of view of the final color.

The colorant to be added is usually in the form of pigments, pigment concentrates, tinters or dyes. Usually, about twelve to sixteen such colorants are required to produce a significant color range of paints, although only frequently three or four are required to produce any given color. The colorants are added to the base paint according to a predetermined recipe, being one of many, stored in a computer. The recipe also indicates which of the base paints should be selected for tinting in order to produce the required color.

Such tinting machines typically comprise a number of reservoirs containing the colorants, a means of delivering the colorant to the container with base paint, for example by one or more manual or automated piston or gear pumps, storage means for the collection of recipes, and control means (manual and/or computerized) for controlling the delivery of colorant in accordance with the selected recipe. The control means may, for example, control the addition of colorant by governing the traverse of pistons in pumps or by activating the pumps for a predetermined time period so that a predetermined volume of colorant is delivered in accordance with the recipe for the selected color. In this way, varying amounts of each colorant may be added to the selected base paint enabling paints of a variety of alternative colors to be produced. Finally, the base paint and added colorant are subjected to mixing, usually by intense shaking, to obtain a homogeneous mixture of base paint and colorant with even color.

Thus, it will be appreciated that the number of different colors that can be produced is determined by the number of different colorants present in the tinting machine, and the number of different base paints. Increasing the number of different colorants and/or the number of base paints will enable a greater number of different colors to be produced.

Known tinting machines have a plurality of colorant reservoirs, each reservoir having its own nozzle from which colorant is dispensed into the base paint. It would be desirable to reduce the complexity of tinting machines to have a single nozzle through which all colorants can be dispensed into the base paint. The problem, however, with using a single nozzle is that the nozzle becomes contaminated with residues of all colorants that pass through. Contamination of the nozzle results in the residual colorants being added to the base paint in a subsequent tinting operation, and therefore the final color of the paint will be incorrect. Therefore, if a single nozzle for a plurality of colorants would be used, a cleaning operation between different tinting operations would be needed.

International application WO99/32205 describes a dispensing machine for metered delivery of fluid products wherein metered quantities of colorants and base paint are fed to a mixing turbine in a dispensing head with a single dispensing nozzle (outlet) and then dispensed into a paint container through the dispensing nozzle. After each dispensing operation, the dispensing head including the mixing turbine and the dispending nozzle are washed with a pressurized solvent that is provided by a washing unit. In the dispensing machine of WO99/32205, rinsing of the dispensing head requires a relatively large volume of cleaning fluid.

It would be desirable to provide a tinting machine with a dispensing head and nozzle that could be cleaned from residual colorants without the need for large amounts of cleaning fluid.

SUMMARY OF THE INVENTION

According to the present invention there is provided a tinting machine with a dispenser head for dispensing one or more colorants into a base paint, which is constructed such that it can be cleaned with a very small amount of cleaning fluid in a cleaning operation after a dispensing operation. The dispenser head has an internal chamber through which, under normal operation, one or more colorants pass before being dispensed into the base paint via its fluid outlet. A piston that is longitudinally and movably arranged in the internal chamber can constrict the free fluid flow path in the internal chamber such that the internal chamber can effectively be cleaned with a small amount of cleaning fluid.

Accordingly, the invention provides in a first aspect a tinting machine comprising a plurality of colorant reservoirs containing colorant, one or more cleaning fluid supply conduits, one or more dispenser heads for dispensing colorant into a paint container, the one or more dispenser heads comprising:

a fluid outlet for dispensing the colorant into the paint container; and an internal chamber having an inner surface and having a downstream end opening in the fluid outlet, wherein each colorant reservoir is fluidly connected to the internal chamber of at least one of the one or more dispenser heads via a colorant supply conduit opening in the internal chamber at a colorant inlet, wherein the one or more cleaning fluid supply conduits are opening in the one or more dispenser heads at a cleaning fluid inlet in the internal chamber, wherein the one or more dispenser heads further comprise a piston having an outer side surface, which piston is longitudinally and movably arranged in the internal chamber such that an annular space is defined by the outer side surface of the piston and the inner surface of the internal chamber, the piston comprising a circumventional protrusion defining a constriction in the annular space, and wherein the piston is movable through the internal chamber between a first position wherein the protrusion is upstream of the colorant inlet, and a second position wherein the protrusion is downstream of the colorant inlet.

Since the dispenser head of the tinting machine according to the invention can be cleaned with a very small amount of cleaning fluid, the tinting machine is particularly suitable for dispensing more than one colorants through a single dispenser head. It will be appreciated that if using more than one colorants in a single dispenser head, the internal chamber and fluid outlet of the single dispenser head need to be cleaned after each dispensing operation to avoid mixing of colorant from a previous dispensing operation with those of a succeeding operation.

A further advantage of the tinting machine according to the invention is that the amount of cleaning fluid needed is small and the cleaning fluid may therefore be dispensed into the paint container without negatively affecting the color and the quality of the final paint.

In a second aspect, the invention relates to a method for dispensing one or more colorants into a paint container with base paint using a tinting machine according to the first aspect of the invention, the method comprising the following steps:

a) supplying colorant from the colorant reservoir via the colorant supply conduit to the internal chamber and dispensing the colorant via the fluid outlet into a paint container whilst the piston is in the first position;
b) supplying a cleaning fluid from a cleaning fluid supply via the cleaning fluid supply conduit to the internal chamber whilst the piston is in a position wherein the protrusion is downstream of the cleaning fluid inlet;
c) moving the piston between the first position and the second position, while cleaning fluid is present in the annular space, to remove residual colorant from the inner surface of the internal chamber to obtain cleaning fluid with residual colorant, and
d) discharging the cleaning fluid with residual colorant from the dispenser head via the fluid outlet.

The movable piston in the internal chamber of the dispenser head allows for easier cleaning of the dispenser head of the tinting machine, and therewith reduces the probability of operational errors. Moreover, the improved cleaning efficiency improves the accuracy of the colorant dispensing operation. Furthermore, the volume of cleaning fluid may be kept sufficiently small to allow waste fluid (i.e. cleaning fluid plus residual colorants) to be discharged directly into the paint container with base paint, without having a material effect on the color of the final paint. Thus, the amount of waste is reduced.

DETAILED DESCRIPTION OF THE INVENTION

Figure 1:
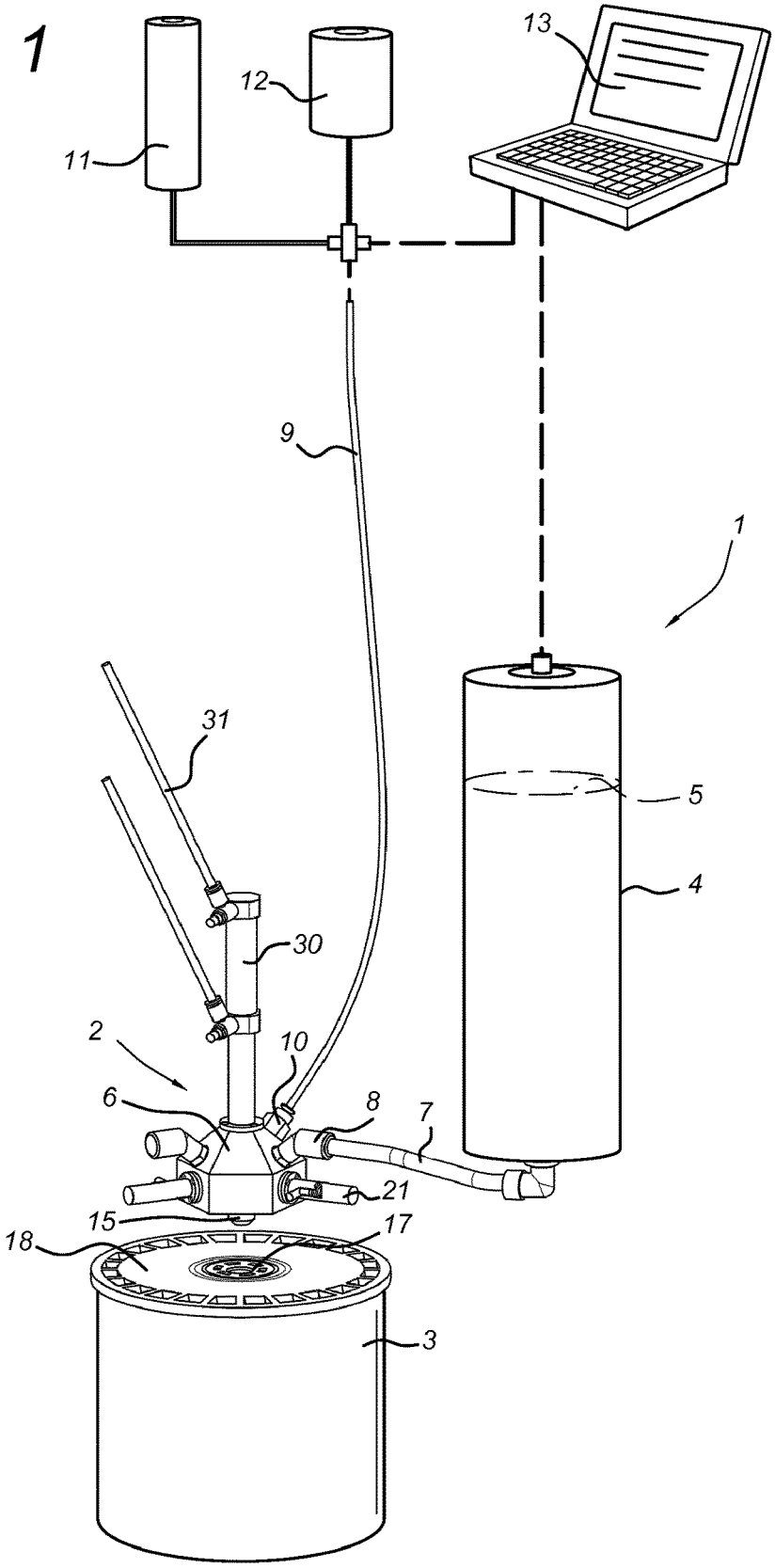
FIG. 1 schematically presents a perspective view of an embodiment of the tinting machine according to the invention.

The tinting machine according to the invention is a tinting machine for dispensing colorant into a paint container, typically a paint container with base paint. The tinting machine preferably is a point-of-sale tinting machine.

The tinting machine comprises a plurality of colorant reservoirs containing colorant, one or more cleaning fluid supply conduits and one or more dispenser heads for dispensing colorant into a paint container. Preferably the one or more dispenser heads are a single dispensing head.

The single dispenser head and, in case of more than one dispenser heads, each of the one of the dispenser heads, comprises a fluid outlet for dispensing the colorant into the paint container. The dispenser head further comprises an internal chamber having an inner surface, preferably a cylindrical inner surface, and a downstream end opening in the fluid outlet. The internal chamber may be defined by any suitable material, such as a tube, an internal bore in a solid material, or combinations thereof.

The fluid outlet may be any suitable fluid outlet. Suitably the fluid outlet is a nozzle aperture of a nozzle located at the downstream end of the internal chamber.

Each of the colorant reservoirs is fluidly connected to the internal chamber of at least one of the one or more dispenser heads via a colorant supply conduit opening in the internal chamber at a colorant inlet. Each colorant reservoir is fluidly connected to the internal chamber via a separate colorant supply conduit opening in the internal chamber at a separate colorant inlet. In the preferred case of a single dispenser head, the internal chamber of the dispensing head thus has several colorant inlets, one for each colorant.

The tinting machine comprises one or more cleaning fluid supply conduits opening in the one or more dispenser heads at a cleaning fluid inlet. Each dispensing head in the tinting machine is provided with at least one cleaning fluid supply conduit, preferably with a single cleaning fluid supply conduit. In a particularly preferred embodiment, the tinting machine has a single dispenser head and a single cleaning fluid supply conduit opening in the single internal chamber. In this embodiment, the internal chamber is provided with a single cleaning fluid inlet.

The cleaning fluid supply inlet may be located upstream or downstream of the colorant inlet in the internal chamber. Preferably, the cleaning fluid inlet port is located upstream of the colorant inlet of the internal chamber, in case of an internal chamber with several colorant inlets, upstream of all colorant inlets.

The terms "downstream" and "upstream" refer herein to positions or directions relative to the direction of flow of colorant through the internal chamber during normal operation of the tinting machine.

The dispenser head further comprises a piston which is longitudinally and movably arranged in the internal chamber. The longitudinal axes of the piston and of the internal chamber coincide. The piston has an outer side surface. An annular space is defined by the outer side surface of the piston and the inner surface of the internal chamber. The annular space forms a fluid flow path that is relatively small compared to the cross-sectional area of the internal chamber. The annular space is sufficiently large to allow cleaning fluid to flow through the annular space. The annular space preferably is sufficiently small to prevent undiluted colorant, which typically has a higher viscosity than the cleaning fluid, from freely flowing through the annular space. The piston further comprises a circumventional protrusion defining a constriction in the annular space. Thus a local, movable constriction is created in the annular space, without completely blocking the annular space.

The piston has a downstream end and a piston head, i.e. a downstream part converging towards its downstream end. Preferably, the protrusion is located at or near the piston head. Reference to 'near the piston head' is to within 2 cm, preferably within 1 cm, more preferably within 0.5 cm from the piston head.

The piston is movable through the internal chamber between a first position, wherein the protrusion is upstream of the colorant inlet, and a second position, wherein the protrusion is downstream of the colorant inlet. In case of an internal chamber with more than one colorant inlets, upstream (first position) and downstream (second position) of all colorant inlets. If the piston is in its first position, colorant(s) that is supplied from a colorant reservoir via the colorant supply conduit(s) to the colorant inlet(s) of the internal chamber, can freely flow through the internal chamber to the fluid outlet to be dispensed into the paint container, without being obstructed by the piston. Preferably, the entire piston is positioned upstream of all colorant inlets in its first position, to allow the colorant(s) to flow through the internal chamber to the fluid outlet.

In its second position, the protrusion is positioned downstream of all colorant inlets. Preferably, the protrusion is downstream of the cleaning fluid inlet, both in the first and in the second position of the piston.

Preferably, the tinting machine further comprises moveable port shutters for selectively closing the colorant inlets. Closing the colorant inlets provides for preventing any residual colorant in the associated colorant supply conduit from flowing into the internal chamber once sufficient colorant has been supplied to the internal chamber. Therewith, the color accuracy of a tinting operation will improve. Closing the colorant inlet(s) also prevents cleaning fluid that is supplied to the internal chamber in a cleaning step from entering the colorant supply conduit(s) via the corresponding colorant inlet(s). Flushing of residual colorants from previous tinting operations is thus avoided. This is particularly advantageous in a cleaning operation wherein cleaning fluid is directly discharged into the paint container with base paint that also received the colorant(s) during the preceding colorant dispensing operation.

Preferably, the tinting machine further comprises a colorant supply regulator for selectively metering a quantity of colorant from the colorant supply conduit into the internal chamber. The regulator may be any suitable regulator, for example a valve. Preferably, the colorant supply regulator is a valve, more preferably a needle valve or a passive check valve. In a particular preferred embodiment, the colorant supply regulator is a needle valve located in the colorant supply conduit near or at the colorant inlet. The dead volume for fluid metering is thus reduced, which lowers the amount of residual colorant that needs to be removed from the internal chamber during a cleaning operation.

Preferably, the port shutter and the fluid supply regulator are formed by the same mechanism, for example by a needle valve that is movable to block the colorant supply conduit and to close the colorant inlet. This configuration significantly reduces the dead volume in the colorant supply conduit near the colorant inlet and thus reduces the quantity of residual colorant that can accumulate at the colorant inlet.

The tinting machine preferably comprises one or more control units configured for controlling a flow of a cleaning fluid from the cleaning fluid supply to the internal chamber, and for controlling motion of the piston through the internal chamber.

The one or more control units may further be configured for independently controlling the colorant supply regulators for each of the respective colorant supply conduits, and for selectively metering quantities of colorants being supplied from the respective colorant supply conduits to the internal chamber.

The tinting machine according to the invention is such that its dispenser head can be cleaned with a very small amount of cleaning fluid. It is thus particularly suitable for a tinting operation wherein the dispenser head is cleaned after each dispense of colorant. In accordance with the advantages and effects described herein above, the invention provides a method for dispensing one or more colorants into a paint container with base paint, using the tinting machine according to the invention, wherein the method comprises a colorant dispensing operation followed by a cleaning operation. The dispensing operation comprises dispensing step a). In step a) one or more colorants are supplied from its respective colorant reservoir via its colorant supply conduit to the internal chamber of the dispenser head. In step a), the piston in the internal chamber is in the first position, so that colorants can freely flow to the fluid outlet to be dispensed in into a paint container with base paint that is positioned below the fluid outlet.

The cleaning operation comprises steps b), c), and d).

In step b), cleaning fluid is supplied from a cleaning fluid supply via the cleaning fluid supply conduit to the internal chamber whilst the piston is in a position wherein the protrusion is downstream of the cleaning fluid inlet. By keeping the constriction in the annular space downstream of the cleaning fluid inlet during supply of cleaning fluid, only a small volume of the internal chamber is available for the cleaning fluid and less cleaning fluid will be needed to rinse the internal chamber and the colorant inlet(s).

Immediately following or already during a first supply of cleaning fluid to the internal chamber, the piston is moved between the first position and the second position (step c)). During step c), cleaning fluid is present in the annular space. By moving the piston between the first and the second position, the constriction in the annular space at the location of the protrusion of the piston is also moving. The moving constriction in the annular space will cause the cleaning fluid to locally accelerate, thus creating a so-called annular blade or knife of cleaning fluid that flows with relatively high velocity. This annular blade of cleaning fluid is capable of rinsing residual colorant from the inner surface of the internal chamber, at least at and directly below the protrusion. Preferably, the piston is moved back and forth between the first and second positions. Thus, residual colorants can be efficiently removed from the inner surface of the internal chamber and from the colorant inlet(s), while requiring only a relatively small quantity of cleaning fluid.

In order to provide for the presence of cleaning fluid in the annular space during step c), cleaning fluid may be continuously or intermittently supplied to the internal chamber. Preferably, the cleaning fluid in the annular space is pressurized during step c), for example by a continuous supply of cleaning fluid to the annular space, at least during a piston stroke, and/or by supplying pressurized air.

During step c), the piston is moved between the first position and the second position one or several times. In general, repositioning of the piston during step c) will cause a sweeping motion of the blade of cleaning fluid through the internal chamber along the colorant inlet(s). Any combination of upwards and/or downwards motions of the piston ("piston strokes") between the first position and the second position may suitable be applied. The term "piston cycle" refers herein to movement of the piston in one direction through the internal chamber, followed by movement in the opposite direction back to the (approximate) initial position. The term "down-up piston cycle" refers herein to a piston cycle including a motion of the piston from the first position through the internal chamber towards the second position, and from the second position back to the first position.

The cleaning fluid may be any suitable cleaning fluid. Preferably, the cleaning fluid is water, air, or a combination of water and air, for example a mixture of water and air or sequentially supplied streams of water, air and/or water-air mixtures. The inventors have found that a mixture of air and water as a cleaning fluid has is highly effective, in particular if water-based colorants are used.

Preferably, pressurized air with a relatively small amount of water is injected into the internal chamber during steps b) and c). The air/water mixture preferably has an air to water volume ratio in a range of from 100 to 10,000, more preferably in a range of from 230 to 5,000, more particularly of from 800 to 1,230.

In an exemplary step c) using air and water as cleaning fluid, pressured air with a small amount of water is supplied to the internal chamber at a cleaning fluid inlet at the top of the chamber. The piston executes several piston cycles between the first and the second position, thereby moving the blade of water and air back and forth past the colorant inlets and other areas of the internal chamber with residual colorant.

The inventors found that the composition of the cleaning fluid may be dynamically adapted in consecutive piston cycles within a single step c), to further improve the cleaning efficiency.

For example, a stream of air may be used as cleaning fluid during an initial piston stroke. This aids removing a major portion of residual colorants from the internal chamber. Subsequent use of a mixture of air and water as cleaning fluid during further piston strokes helps to rinse further residual colorants, in particular residual colorant accumulated in recesses around the colorant inlet(s).

In a preferred embodiment, step c) comprises:

i) a first down-up piston cycle using air as a first cleaning fluid;
ii) a second down-up piston cycle using a mixture of water and air as a second cleaning fluid;
iii) a third down-up piston cycle using a mixture of water and air as a third cleaning fluid;
iv) a fourth down-up piston cycle using air as a fourth cleaning fluid;

To further improve the cleaning efficiency, the last three piston cycles may be repeated, so that cleaning step c) further comprises:

v) a fifth down-up piston cycle using a mixture of water and air as a fifth cleaning fluid;
vi) a sixth down-up piston cycle using a mixture of water and air as a sixth cleaning fluid, and
vii) a seventh down-up piston cycle using air as a seventh cleaning fluid.

The cleaning fluid supply may be any suitable cleaning fluid supply, for example an air compressor and air storage tank. The output of such compressor may be used as a direct source of cleaning fluid during piston cycles. Air can then be fed directly from the compressor and/or air storage tank in a controlled manner (e.g. using first air check valves) through the cleaning fluid supply conduit into the internal chamber.

Alternatively or additionally, the output of the air compressor may be used as an indirect source during piston cycles wherein a mixture of water and air is used as cleaning fluid. Air is then fed from the air compressor and/or the air storage tank in a controlled manner (e.g. using further air check valves) to a water storage tank. In this case, the air pressure may serve to control the flow of the mixture of water and air from the water storage tank (e.g. using fluid check valves) through the cleaning fluid supply conduit into the internal chamber.

Typical operating pressures for the air compressor may be set such that the resulting line pressure in the cleaning fluid supply conduit will be around 2 bar (absolute). The air compressor may additionally be configured for simultaneous use as a pneumatic source for controlling a piston actuator.

In step c), cleaning fluid with residual colorant is obtained. In step d), the cleaning fluid with residual colorant is discharged from the dispenser head via the fluid outlet. Preferably, the cleaning fluid with the residual colorant is discharged directly into the paint container.

Step d) may be carried out during and/or directly after step c). In some embodiments, cleaning fluid with residual colorant will flow past the constriction in the annular space towards the fluid outlet and can already be discharged during step c). Alternatively or additionally, cleaning fluid with residual colorant may be discharged in a separate step d).

The amount of cleaning fluid used in the method according to the invention is typically small. The amount of cleaning fluid other than air is preferably less than 10 millilitres, more preferably less than 5 millilitres and can be as small as 2 or 3 millilitres. If directly discharged in the paint container with base paint to be tinted, such a small volume will have no significant effect on the color accuracy of the final tinted paint product.

Since the tinting machine according to the invention is particularly suitable for dispensing several colorants from a single disperser head, the colorants may advantageously be directly dispensed into a paint container that is closed with a lid via a valve in the lid, wherein the dispenser head comprises a fluid dispenser nozzle adapted to engage with the valve so that the valve opens when engaged with the nozzle. Thus, colorants can be dispensed through the lid of the paint container. Preferably, also the cleaning fluid is directly discharged through the opened valve in the paint container.

DESCRIPTION OF EMBODIMENTS

Tinting Machine Embodiment: FIG. 1

FIG. 1 shows an embodiment of a tinting machine according to the invention and a paint container. In this embodiment, tinting machine 1 is adapted for dispensing a colorant via dispenser head 2 into paint container 3. Tinting machine 1 comprises a plurality of colorant reservoirs 4 (only one such colorant reservoir 4 is shown for simplicity). Each of reservoirs 4 contains colorant fluid 5. Dispenser head 2 comprises manifold 6 with an internal chamber defined inside the manifold (not visible in FIG. 1, see FIGS. 3*a*-3*d*). In the embodiment of FIG. 1, the colorant supply conduit that fluidly connects reservoir 4 to the internal chamber of dispenser head 2 is formed by tube 7, which is connected to manifold 6 by coupling 8. Cleaning fluid supply conduit 9 is coupled via coupling 10 to manifold 6. During operation of tinting machine 1, cleaning fluid supply conduit 9 may supply cleaning fluid such as water, air or a mixture thereof from air supply 11 and/or from water supply 12 to the internal chamber of dispenser head 2.

Tinting machine 1 further comprises control unit 13 that is configured for controlling supply of colorants to dispenser head 2 during a colorant dispensing step, and for controlling supply of the cleaning fluid to dispenser head 2 during a subsequent cleaning step. Control unit 13 may be uploaded with instruction to execute single colorant doses, multiple colorant doses, various dose sizes, various flush cycles, etc. Control unit 13 may be part of a user interface, or be in signal communication with such user interface.

Dispenser Head of the Tinting Machine Embodiment: FIGS. 2, 3*a*-3*d* and 4

Figure 2:
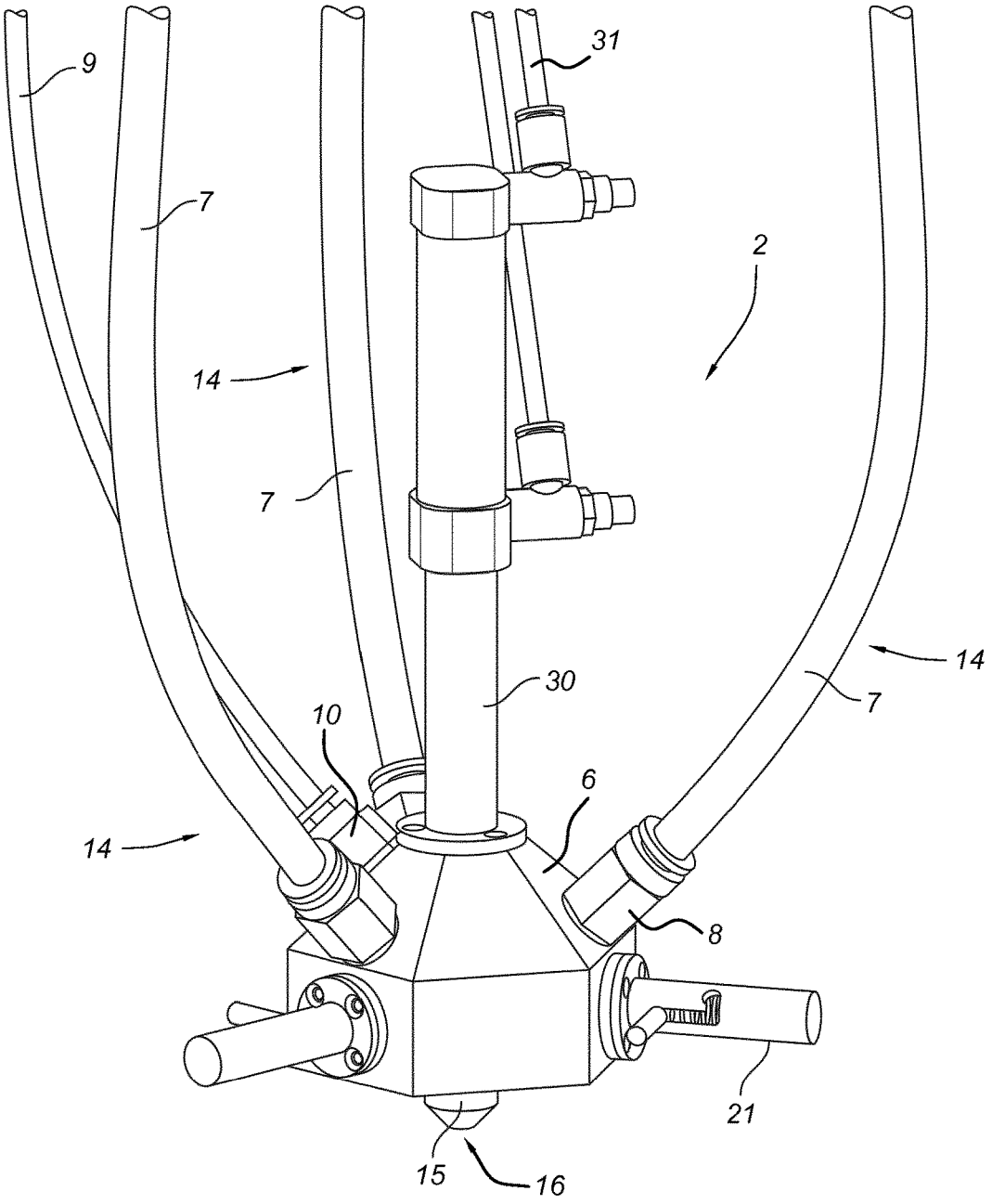
FIG. 2 presents a perspective view of a dispenser head with several colorant supply conduits and one cleaning fluid supply conduit of the tinting machine of FIG. 1.

FIG. 2 shows a perspective view of part of the tinting machine of FIG. 1 (dispenser head). FIGS. 3*a*-3*d* show a longitudinal section of the dispenser head of FIG. 2 and illustrate normal operation of the tinting machine of FIG. 1. FIG. 4 presents a longitudinal section of the dispenser head of FIG. 2 showing the constriction in the annular space in more detail.

In FIG. 2, it is shown dispenser head 2 with multiple colorant supply conduits 14, comprising manifold 6 formed by a solid body of a rigid material, for stainless steel. Manifold 6 includes nozzle 15, which includes nozzle aperture 16 that forms the fluid outlet for dispensing colorant from dispenser head 2 into paint container 3 (see FIG. 1). Nozzle 15 with fluid outlet 16 may be adapted for releasably engaging with a valve 17 in lid 18 of paint container 3 (see FIG. 1), so that colorants and cleaning fluid may be injected by dispenser head 2 directly into paint container 3 without removing lid 18 from paint container 3.

FIGS. 3*a*-3*d* show that dispenser head 2 has an internal chamber 19 for allowing colorant 5 to flow towards fluid outlet 16. In this embodiment internal chamber 19 is formed by an elongated substantially vertical cylindrical bore through manifold 6.

Figure 3A:
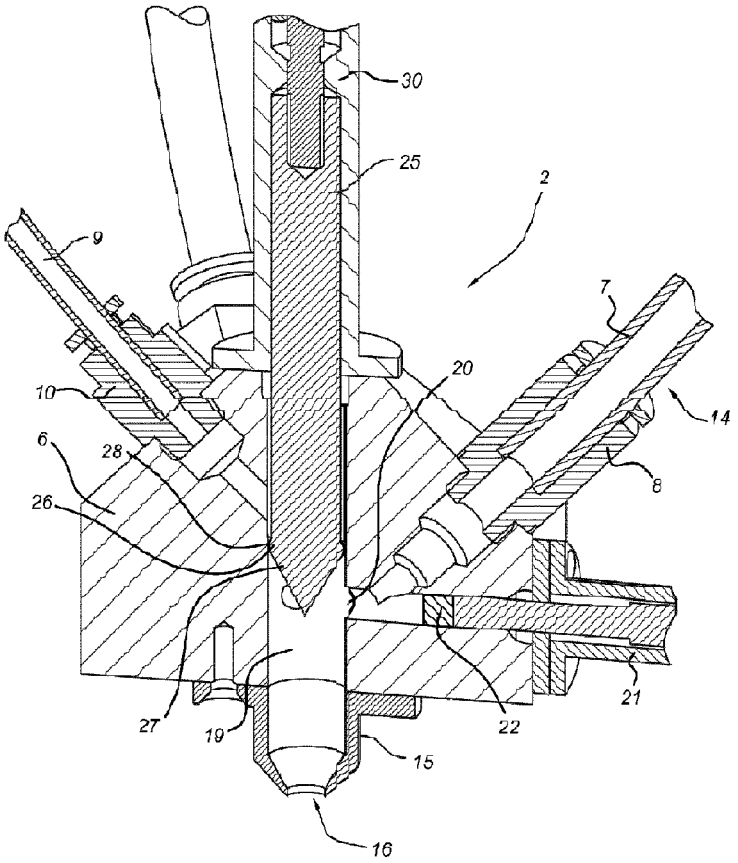
FIG. 3*a*-3*d* present longitudinal sections of the dispenser head of FIG. 2, and illustrate a method of operation of the tinting machine.
Figure 3B:
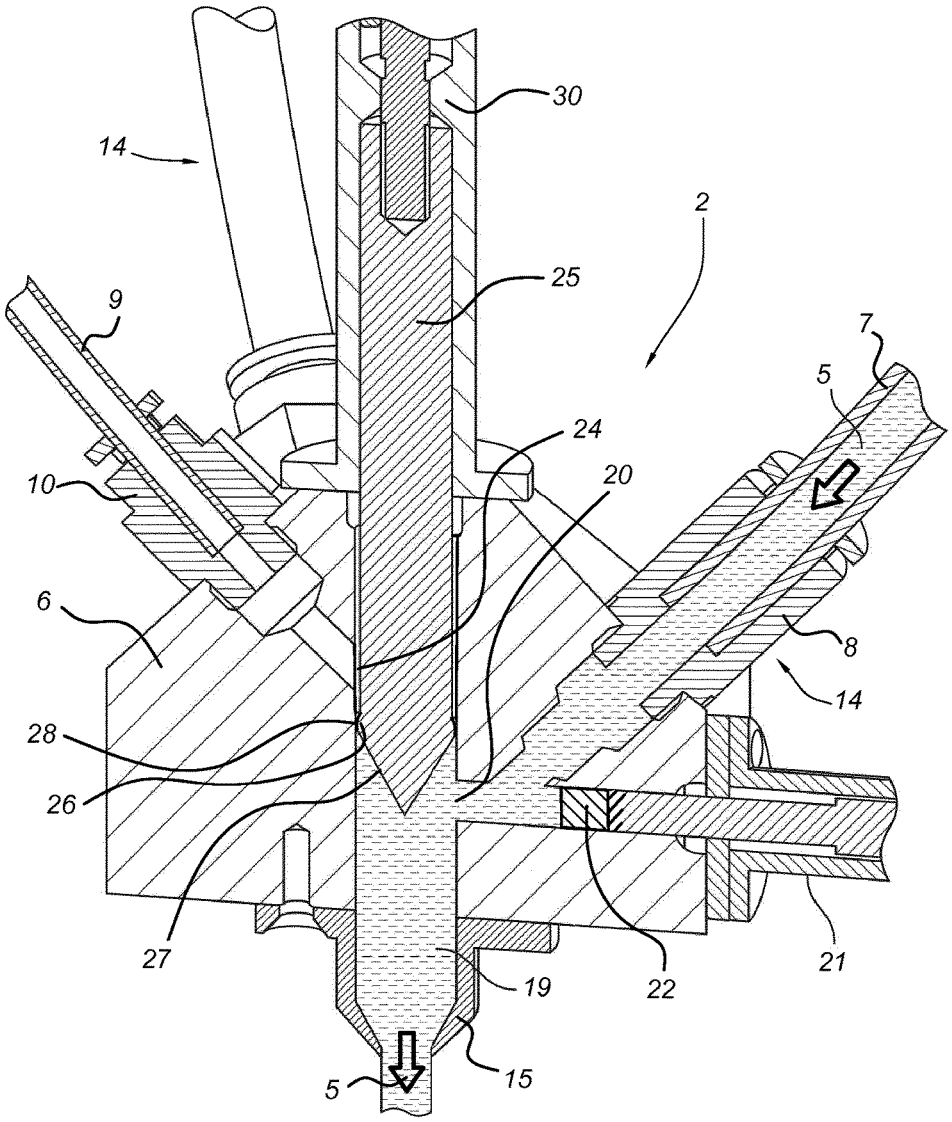
Figure 3C:
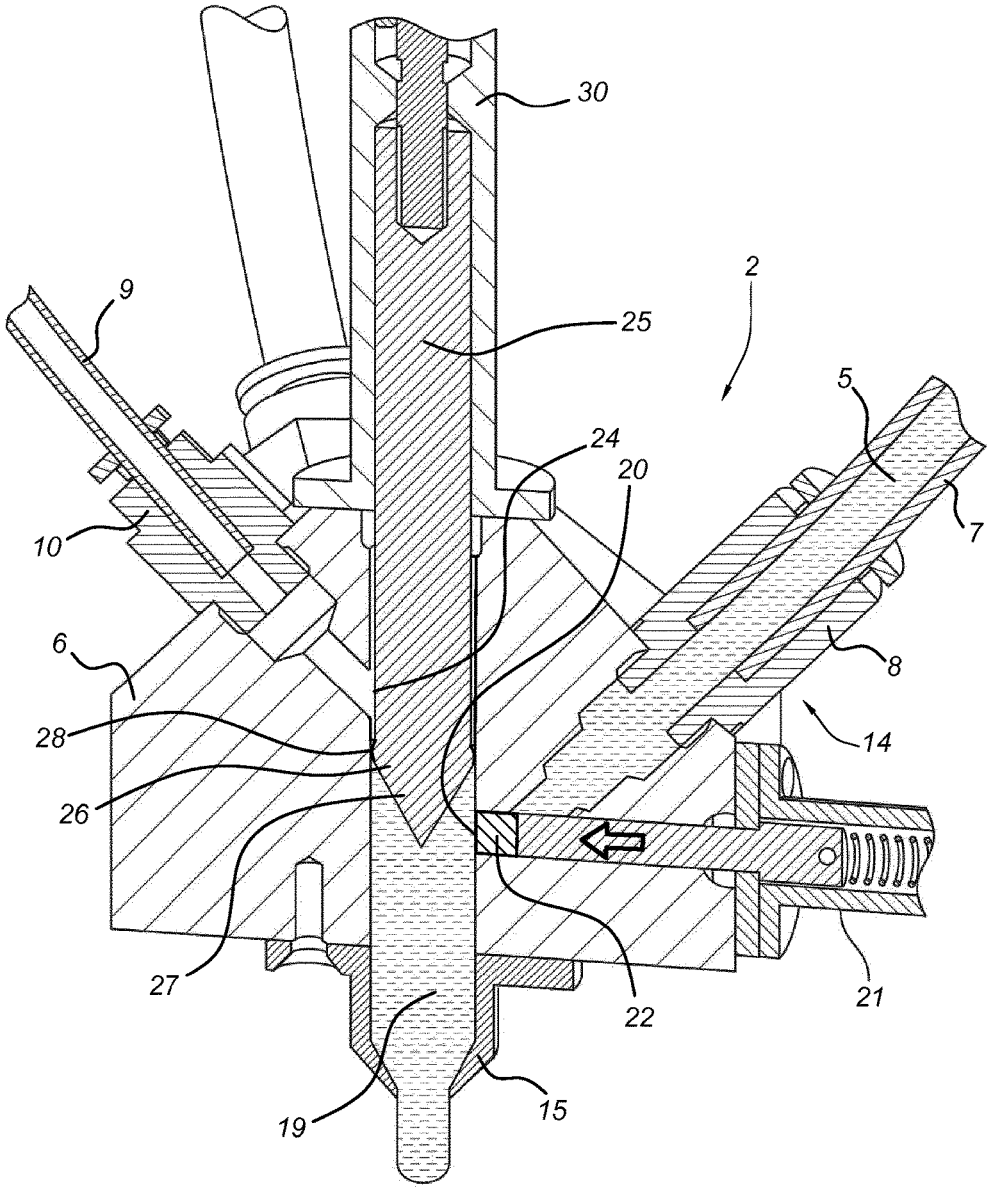

Colorant inlet conduits 14 open in internal chamber 19 at colorant inlets 20 (only one colorant inlet shown in FIGS. 3*a*-3*c*). Fluid supply regulators 21 (e.g. a needle valve with a port shutter 22 on a leading end thereof), can selectively open and close corresponding colorant inlet 20. Fluid supply regulator 21 may further be adapted for metering quantities of colorant 5 from colorant supply conduit 14 into internal chamber 19. In the embodiment of FIGS. 1-3, metering of fluid supply from colorant inlet conduit 14 occurs at colorant inlet 20. Hence, the dead volume for fluid metering from inlet conduit 14 is reduced. This reduces the amount of residual colorant that needs to be removed during a cleaning step.

Each of colorant supply conduits 14 opens at a separate colorant inlet 20 in internal chamber 19. Preferably, each inlet port shutter 22 and each fluid supply regulator 21 is individually controllable.

Cleaning fluid supply conduit 9 is adapted for supplying cleaning fluid 23 via cleaning fluid inlet 24 in internal chamber 19 during a cleaning step.

Dispenser head 2 comprises piston 25 arranged inside internal chamber 19. Piston 25 comprises a circumventional protrusion 26, which is, in this embodiment, positioned near piston head 27. Protrusion 26 forms a local widening of piston 25 and creates a movable constriction 28 in annular space 29 (see FIG. 4).

During cleaning of dispenser head 2, downward movement of piston 32 and therewith of constriction 28 in annular space 29, will cause local acceleration of the flow of cleaning fluid, thus creating a so-called annular blade or knife of cleaning fluid that flows with a relatively high velocity in the downstream direction. This annular blade of cleaning fluid is capable of rinsing residual colorant from the inner surface of internal chamber 19, at least at and directly below protrusion 26. In this embodiment, piston head 27 with protrusion 26 remains downstream of cleaning fluid inlet port 24 during the cleaning step, so that cleaning fluid 23 can only flow through annular space 29, thus minimizing the quantity of cleaning fluid needed.

Dispenser head 2 comprises piston mount 30, which is attached to manifold 6. Piston mount 30 may comprise or be coupled to actuator 31 (see FIGS. 1 and 2) for regulating the motion of piston 25 inside internal chamber 19 during a cleaning step. Control unit 13 of tinting machine 1 may be configured for controlling actuator 31 during a cleaning step. Piston actuator 31 may be actuated by pneumatic or hydraulic systems, or other suitable actuation mechanisms.

Piston 25 is movable along the internal chamber 19 between a first position (e.g. FIGS. 3*a*-3*c*) wherein protrusion 27 is located upstream of all colorant inlets 20, and a second position (e.g. FIG. 3*d*) wherein protrusion 26 is positioned downstream of all colorant inlets 20.

During a cleaning operation (FIG. 3*d*), piston 25 is moved back and forth and cleaning fluid 23 is caused to flow through annular space 29 and is locally accelerated at constriction 28. Thus, cleaning fluid 23 is swept along colorant inlets 20, removing residual colorant from inlets 20. Preferably, inlets 20 are temporarily closed during a cleaning operation, so that residual colorants are more efficiently removed from the inlets 20 by passing cleaning fluid 23.

In the embodiments shown in FIGS. 2, 3*a*-3*d* and 4, piston 25 comprises a piston head 27 downstream of protrusion 26 which is converging in downstream direction. The inner surface of internal chamber 19 is also converging in downstream direction near its downstream end, such that the converging outer surface of piston head 27 and the converging inner surface of internal chamber 19 are complementary shaped. If during or after a cleaning step, piston 25 approaches fluid outlet 16, any cleaning fluid 23 present in internal chamber 19 will be forced to radially converge and will be expelled through the fluid output 16. The complementary shapes of piston head 27 and downstream part of internal chamber 19 assist in more completely expelling cleaning fluid 23 with residual colorant from dispenser head 2.

Method for Using the Tinting Machine: FIGS. 3*a*-3*d*

FIGS. 1 and 3*a*-3*d* illustrate an operation of the tinting machine embodiment shown in FIGS. 1-4.

A customer in a paint store may inform an operator of tinting machine 1 (e.g. a store-based employee) of the desired paint color. The operator may input the specifics of that color into tinting machine 1 via a user interface of control unit 13. Control unit 13 is preferably configured to automatically select the correct base paint and the required amounts and types of colorant. The operator may then position a base paint container 3 under fluid dispenser nozzle 15 of tinting machine 1, and activate a tinting process via the user interface. Alternatively, tinting machine 1 may comprise a receptacle or platform (not shown) for retaining base paint container 3 and for moving the container into a proper position and/or orientation with respect to fluid dispenser nozzle 15.

Usually, colored coating compositions require several colorants to be dispensed into the base paint. On initiation of the colorant dispensing process, a pump draws colorant 5 from a particular reservoir 4 and supplies to via colorant supply conduit 14 to internal chamber 19 in dispenser head 2.

FIG. 3*a* shown an initial state of dispenser head 2 prior to supply of colorant to internal chamber 19. Piston 25 is arranged inside internal chamber 19 in a first position wherein colorant inlets 20 are located downstream of protrusion 26.

Upon selection of a particular colorant, control unit 13 will cause fluid supply regulator 21 to open corresponding colorant inlet 20, to allow a flow of corresponding colorant 5 from reservoir 4 (not shown) via colorant supply conduit 14 into internal chamber 19 before being dispensed through fluid outlet 16 (see FIG. 3*b*) into base paint container 3.

FIG. 3*c* illustrates that once the selected amounts of selected colorants 5 have been supplied to internal chamber 19, corresponding fluid supply regulator(s) 21 may be actuated to close corresponding colorant inlets 20, to prevent further flow of colorant 5 into internal chamber 19.

Figure 3D:
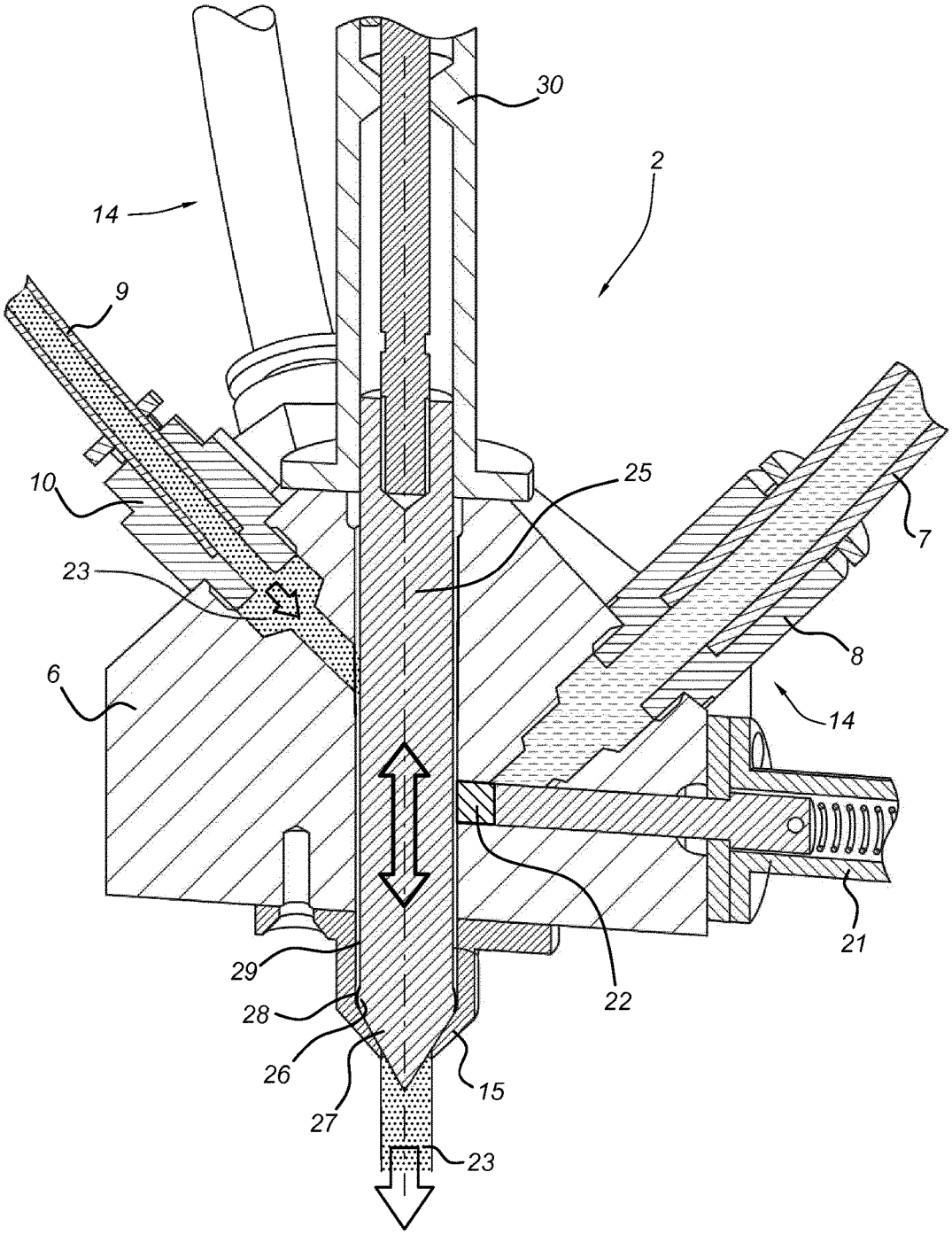
Figure 4:
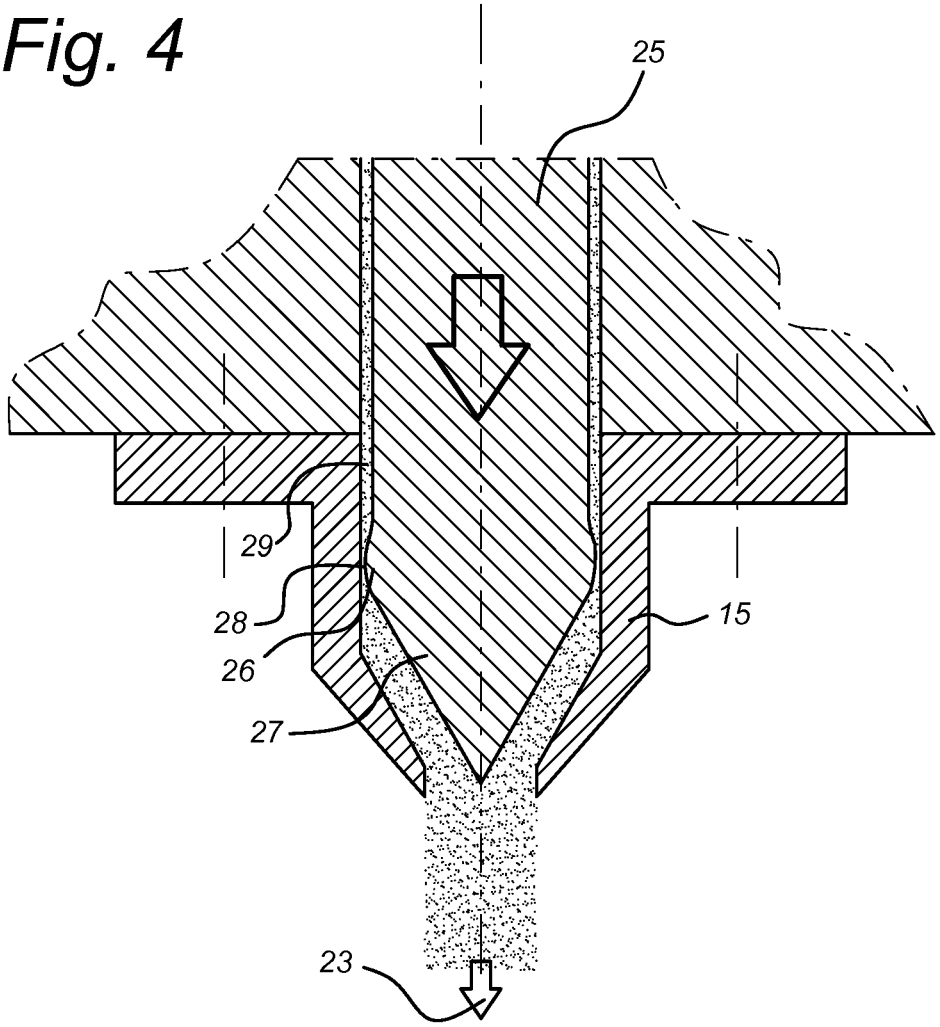
FIG. 4 presents a longitudinal section of the dispenser head of FIG. 2 showing the constriction in the annular space.

FIG. 3*d* illustrates how a subsequent cleaning operation may be carried out. Control unit 13 activates cleaning fluid supplies 11 and/or 12 (see FIG. 1) to allow cleaning fluid 23 to flow in cleaning fluid supply conduit 9 so that it is supplied via cleaning fluid inlet port 24 into internal chamber 19. Piston 25 is then moved between its first and second position (in FIG. 3*d*, piston is shown in the second position) so that constriction 28 in annular space 29 is moving along colorant inlets 20.

FIG. 4 shows annular space 29 and local constriction 28 in more detail. Annular space 29 and constriction 28 are formed so as to allow cleaning fluid 23 to pass the constriction towards fluid outlet 16.

The invention claimed is:

1. A tinting machine comprising a plurality of colorant reservoirs containing colorant, one or more cleaning fluid supply conduits, one or more dispenser heads for dispensing colorant into a paint container, the one or more dispenser heads comprising:

a fluid outlet for dispensing the colorant into the paint container; and an internal chamber having an inner surface and having a downstream end opening in the fluid outlet, wherein each colorant reservoir is fluidly connected to the internal chamber of at least one of the one or more dispenser heads via a colorant supply conduit opening in the internal chamber at a colorant inlet, wherein the one or more cleaning fluid supply conduits are opening in the one or more dispenser heads at a cleaning fluid inlet in the internal chamber, wherein the one or more dispenser heads further comprise a piston having an outer side surface, which piston is longitudinally and movably arranged in the internal chamber such that an annular space is defined by the outer side surface of the piston and the inner surface of the internal chamber, the piston comprising a circumventional protrusion defining a constriction in the annular space, and wherein the piston is movable through the internal chamber between a first position wherein the protrusion is upstream of the colorant inlet, and a second position wherein the protrusion is downstream of the colorant inlet.

2. The tinting machine according to claim 1, wherein the one or more dispenser heads is a single dispenser head and wherein each colorant reservoir is fluidly connected to the internal chamber of the single dispenser head via a separate colorant supply conduit opening in the internal chamber at a separate colorant inlet, and wherein in the first position of the piston, the protrusion is upstream of all colorant inlets, and wherein in the second position of the piston, the protrusion is downstream of all colorant inlets.

3. The tinting machine according to according to claim 1, wherein the cleaning fluid inlet is located upstream of the colorant inlet.

4. The tinting machine according to claim 3, wherein in the first position, the protrusion is downstream of the cleaning fluid inlet.

5. The tinting machine according to claim 1 comprising movable port shutters for selectively closing the colorant inlets.

6. The tinting machine according to claim 1 comprising a colorant supply regulator for selectively metering a quantity of colorant via the colorant supply conduit into the internal chamber.

7. The tinting machine according to claim 1, adapted for dispensing colorant directly into a paint container that is closed with a lid provided with a valve, wherein the dispenser head comprises a fluid dispenser nozzle which includes the fluid outlet, and which is adapted for engaging with the valve.

8. A method for dispensing one or more colorants into a paint container with base paint using a tinting machine according to claim 1, the method comprising:

a) supplying colorant from the colorant reservoir via the colorant supply conduit to the internal chamber and dispensing the colorant via the fluid outlet into a paint container whilst the piston is in the first position;

b) supplying a cleaning fluid from a cleaning fluid supply via the cleaning fluid supply conduit to the internal chamber whilst the piston is in a position wherein the protrusion is downstream of the cleaning fluid inlet;

c) moving the piston between the first position and the second position, while cleaning fluid is present in the annular space, to remove residual colorant from the inner surface of the internal chamber to obtain cleaning fluid with residual colorant, and d) discharging the cleaning fluid with residual colorant from the dispenser head via the fluid outlet.

9. The method according to claim 8, wherein cleaning fluid is supplied to the internal chamber during c).

10. The method according to claim 8, comprising discharging the cleaning fluid with residual colorant directly into the paint container.

11. The method according to claim 8, wherein a) comprises supplying a plurality of colorants to the internal chamber of a single dispenser head.

12. The method according to claim 8, wherein the cleaning fluid is water, air, or a combination of water and air.

13. The method according to claim 8, where air, water or a mixture of water and air are sequentially supplied to the internal chamber during b) and/or c).

* * * * *